US009215527B1

(12) United States Patent
Saric et al.

(10) Patent No.: US 9,215,527 B1
(45) Date of Patent: Dec. 15, 2015

(54) MULTI-BAND INTEGRATED SPEECH SEPARATING MICROPHONE ARRAY PROCESSOR WITH ADAPTIVE BEAMFORMING

(75) Inventors: Zoran M. Saric, Belgrade (RS); Stanislav Ocovaj, Novi Sad (RS); Robert Peckai-Kovac, Veternik (RS); Jelena Kovacevic, Novi Sad (RS)

(73) Assignee: CIRRUS LOGIC, INC., Austin, TX (US)

( * ) Notice: Subject to any disclaimer, the term of this patent is extended or adjusted under 35 U.S.C. 154(b) by 988 days.

(21) Appl. No.: 12/759,003

(22) Filed: Apr. 13, 2010

Related U.S. Application Data

(60) Provisional application No. 61/286,188, filed on Dec. 14, 2009.

(51) Int. Cl.
*G10L 21/0208* (2013.01)
*H04R 3/00* (2006.01)
*H04R 1/40* (2006.01)

(52) U.S. Cl.
CPC ..... *H04R 3/005* (2013.01); *H04R 1/406* (2013.01)

(58) Field of Classification Search
USPC ..... 381/92, 71.11, 71.1, 94.2, 94.3, 94.1, 381/122; 704/235
See application file for complete search history.

(56) References Cited

U.S. PATENT DOCUMENTS 4,628,526 A 12/1986 Germer
4,628,529 A 12/1986 Borth et al.
4,827,458 A 5/1989 Dalayer de Costemore D'Arc
4,963,034 A 10/1990 Cuperman et al.
5,509,081 A 4/1996 Kuusama
5,550,923 A 8/1996 Hotvet
6,198,668 B1 3/2001 Watts
6,792,118 B2 * 9/2004 Watts ..... H04R 3/005 348/14.01
6,944,474 B2 9/2005 Rader et al.
7,035,415 B2 4/2006 Belt et al.
7,076,315 B1 7/2006 Watts (Continued)

FOREIGN PATENT DOCUMENTS

WO WO2008041878 A2 4/2008

OTHER PUBLICATIONS

L.A. Drake, J.C. Rutledge, J. Zhang, A. Katsaggelos, A Computational Auditory Scene Analysis-Enhanced Beamforming Approach for Sound Source Separation, Aug. 12, 2009, Hindawi Publishing Corporation, Colume 2009, 17 pages.*

(Continued)

*Primary Examiner* — Duc Nguyen
*Assistant Examiner* — George Monikang
(74) *Attorney, Agent, or Firm* — Mitch Harris, Atty at Law, LLC; Andrew M. Harris

(57) ABSTRACT

A speech separating digital signal processing system and algorithms for implementing speech separation combine beam-forming with residual noise suppression, such as computational auditory scene analysis (CASA) using a beamformer that has a primary lobe steered toward the source of speech by a control value generated from an adaptive filter. An estimator estimates the ambient noise and provides an input to the residual noise suppressor, and a post-filter may be used to noise-reduce the output of the estimator using a time-varying filter that compares two or more outputs of the beamformer with a quasi-stationary model of the speech and ambient noise.

25 Claims, 6 Drawing Sheets

(56) References Cited

U.S. PATENT DOCUMENTS

| | | | | |
|---|---|---|---|---|
| 7,174,022 | B1 | 2/2007 | Zhang et al. | |
| 7,319,959 | B1 | 1/2008 | Watts | |
| 7,343,022 | B2 | 3/2008 | Kates | |
| 7,508,948 | B2 | 3/2009 | Klein et al. | |
| 7,903,825 | B1 | 3/2011 | Melanson | |
| 2001/0046304 | A1 | 11/2001 | Rast | |
| 2002/0016966 | A1 | 2/2002 | Shirato | |
| 2002/0051546 | A1 | 5/2002 | Bizjak | |
| 2002/0075965 | A1 | 6/2002 | Claesson et al. | |
| 2002/0193090 | A1 | 12/2002 | Sugar et al. | |
| 2003/0161097 | A1 | 8/2003 | Le et al. | |
| 2005/0020223 | A1 | 1/2005 | Ellis et al. | |
| 2005/0146534 | A1 | 7/2005 | Fong et al. | |
| 2005/0190927 | A1 | 9/2005 | Petroff | |
| 2006/0222184 | A1* | 10/2006 | Buck | G10L 21/0208 381/71.1 |
| 2007/0053528 | A1 | 3/2007 | Kim et al. | |
| 2008/0215321 | A1* | 9/2008 | Droppo et al. | 704/235 |
| 2008/0232607 | A1 | 9/2008 | Tashev et al. | |
| 2009/0034752 | A1* | 2/2009 | Zhang et al. | 381/92 |
| 2009/0067642 | A1* | 3/2009 | Buck | H04R 3/005 381/94.1 |
| 2010/0177908 | A1* | 7/2010 | Seltzer | H04R 3/005 381/92 |

OTHER PUBLICATIONS

Drake, et al., Sound Source Separation via Computational Auditory Scene Analysis-Enhancing Beamforming Proceedings of the IEEE Sensor Array and Multichannel Signal Processing Workshop, Rosslyn, VA, 2002.

Drake, et al., "A Computational Auditory Scene Analysis-Enhanced Beamforming Approach for Sound Source Separation", EURASIP Journal on Advances in Signal Processing, vol. 2009, 2009.

Hu, et al.,"Auditory Segmentation Based on Onset and Offset Analysis", IEEE ASSP Transactions, vol. 15, No. 2, Feb. 2007, Piscataway, NJ.

V. Hohnmann, "Frequency Analysis and Synthesis Using a Gammatone filterbank", ACTA Acustica United with Acustica, 2002, vol. 88 pp. 433-442, Hizel Verlag, Stuttgart DE.

Brown, et al., "Separation of Speech by Computational Auditory Scene Analysis", Speech Enhancement, 2005, pp. 371-402, Springer NY.

Roman, et al.,"Speech segregation based on sound localization", Journal of the Acoustical Society of America, 2003, vol. 114, pp. 2236-2252, US.

Meir Tzur (Zibulski), et al., "Sound Equalization in a Noisy Environment", 110th Convention of the AES, May 2001, Amsterdam, NL.

Kates, et al., "Multichannel Dynamic-Range Compression Using Digital Frequency Warping", EURASIP Journal on Applied Signal Processing, 2005, pp. 3003-3014, vol. 2005:18, Kessariani, GR.

Janssen, Volker, "Detection of abrupt baseline length changes using cumulative sums", Journal of Applied Geodesy, Jun. 2009, pp. 89-96, vol. 3, Issue 2, Berlin, DE.

Cohen, et al., "Noise Estimation by Minima Controlled Recursive averaging for Robust Speech Enhancement", IEEE Signal Processing Letters, Jan. 2002, pp. 12-15, vol. 9, No. 1, IEEE Press, Piscataway, NJ.

* cited by examiner

MULTI-BAND INTEGRATED SPEECH SEPARATING MICROPHONE ARRAY PROCESSOR WITH ADAPTIVE BEAMFORMING

This U.S. Patent Application claims priority under 35 U.S.C. §119(e) to U.S. Provisional Patent Application 61/286,188 filed on Dec. 14, 2009.

BACKGROUND OF THE INVENTION

1. Field of the Invention

The present invention relates generally to audio communication systems, and more specifically, to techniques for separating speech from ambient acoustic noise.

2. Background of the Invention

The problem of separation of speech from one or more persons speaking in a room or other environment is central to the design and operation of systems such as hands-free telephone systems, speaker phones and other teleconferencing systems. Further, the separation of speech from other sounds in an ambient acoustic environment, such as noise, reverberation and other undesirable sounds such as other speakers can be usefully applied in other non-duplex communication or non-communication environments such as digital dictation devices, computer voice command systems, hearing aids and other applications in which reduction of sounds other than desired speech provides an improvement in performance.

Processing systems that separate desired speech from undesirable background sounds and noise may use a single microphone, or two or more microphones forming a microphone array. In single microphone applications, the processing algorithms typically rely entirely on source-attribute filtering algorithms that attempt to isolate the speech (source) algorithmically, for example computational auditory scene analysis (CASA). In some implementations, two or more microphones have been used to estimate the direction of desired speech. The algorithms rely on separating sounds received by the one or more microphones into types of sounds, and in general are concerned with filtering the background sound and noise from the received information.

However, when practical, a microphone array can be used to provide information about the relative strength and arrival times of sounds at different locations in the acoustic environment, including the desired speech. The algorithm that receives input from the microphone array is typically a beamforming processing algorithm in which a directivity pattern, or beam, is formed through the frequency band of interest to reject sounds emanating from directions other than the speaker whose speech is being captured. Since the speaker may be moving within the room or other environment, the direction of the beam is adjusted periodically to track the location of the speaker.

Beam-forming speech processing systems also typically apply post-filtering algorithms to further suppress background sounds and noise that are still present at the output of the beam-former. However, until recently, the source-attribute processing techniques were not used in beam-forming speech processing systems. The typical filtering algorithms employed are fast-Fourier transform (FFT) algorithms that attempt to isolate the speech from the background, which have relatively high latency for a given signal processing capacity.

Since source-attribute filtering techniques such as CASA rely on detecting and determining types of the various sounds in the environment, inclusion of a beam-former having a beam directed only at the source runs counter to the detection concept. For the above reason, combined source-attribute filtering and location-based techniques typically use a wideband multi-angle beam-former that separates the scene being analyzed by angular location, but still permits analysis of the entire ambient acoustic environment. The wideband multi-angle beam-formers employed do not attempt to cancel all signals other than the direct signal from the speech source, as a narrow beam beam-former would, and therefore loses some signal-to-noise-ratio reduction by not providing the highest possible selectivity through the directivity of a single primary beam.

Therefore, it would be desirable to provide improved techniques for separating speech from other sounds and noise in an acoustic environment. It would further be desirable to combine source-attribute filtering with narrow band source tracking beam-forming to obtain the benefits of both. It would further be desirable to provide such techniques with a relatively low latency.

SUMMARY OF THE INVENTION

The above stated objective of separating a particular speech source from other sounds and noise in an acoustic environment is accomplished in a system and method. The method is a method of operation of the system, which may be a digital signal processing system executing program instructions forming a computer program product embodiment of the present invention.

The system receives multiple microphone signals from microphones at multiple positions and filters each of the microphone signals to split them into multiple frequency band signals. A spatial beam is formed having a primary lobe with a direction adjusted by a beam-former. The beam-former receives the multiple frequency band signals for each of the multiple microphone signals. At least one of the multiple frequency band signals is adaptively filtered to periodically determine a position of the speech source and generate a steering control value. The direction of the primary lobe of the beam-formed is adjusted by the steering control value toward the determined position of the speech source. The ambient acoustic noise is estimated and at least one output of the beam-former is processed using a result of the estimating to suppress residual noise to obtain the separated speech.

The foregoing and other objectives, features, and advantages of the invention will be apparent from the following, more particular, description of the preferred embodiment of the invention, as illustrated in the accompanying drawings.

DESCRIPTION OF ILLUSTRATIVE EMBODIMENT

The present invention encompasses audio processing systems that separate speech from an ambient acoustic background (including other speech and noise). The present invention uses a steering-controlled beam-former in combination with residual noise suppression, such as computational auditory scene analysis (CASA) to improve the rejection of unwanted audio signals in the output that represents the desired speech signal. In the particular embodiments described below, the system is provided in a mobile phone that enables normal phone conversation in a noisy environment. In implementation such as the mobile telephone depicted herein, the present invention improves speech quality and provides more pleasant phone conversation in a noisy acoustic environment. Also, the ambient sound is not transmitted to the distant talker, which improves clarity at the receiving end and efficiently uses channel bandwidth, particularly in adaptive coding schemes.

Figure 1:
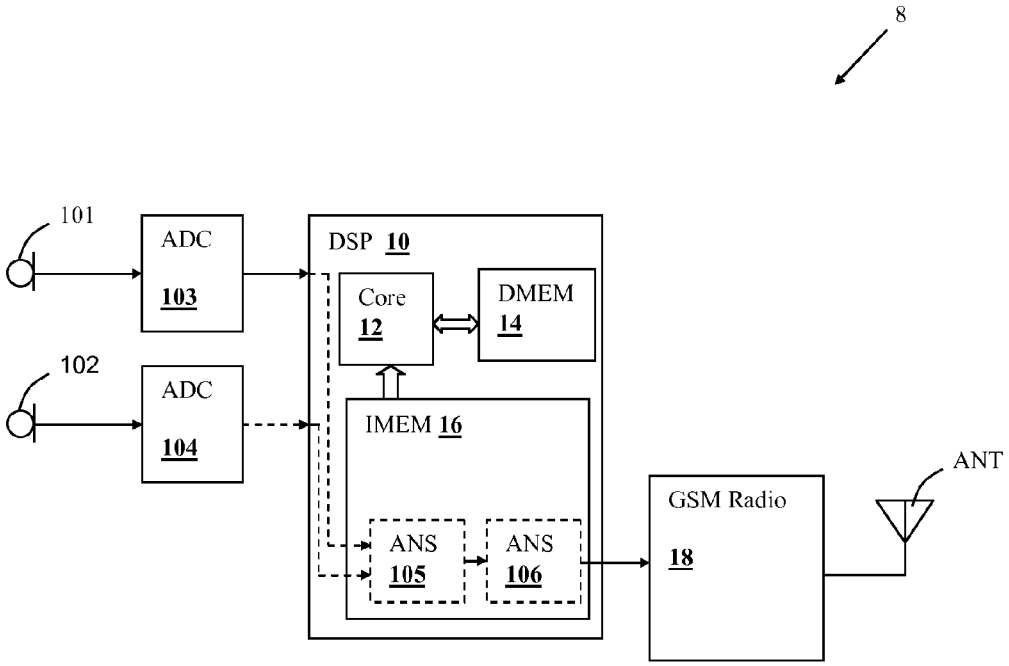
FIG. 1 is a block diagram depicting global system for mobile communications (GSM) telephone in accordance with an embodiment of the present invention.

Referring now to FIG. 1, a mobile telephone 8 in accordance with an embodiment of the present invention is shown. Signals provided from a first microphone 101 and a second microphone 102 provide inputs to respective analog-to-digital converter (ADC) 103 and ADC 104. Microphones 101 and 102 are closely-spaced, according to the dimensions of packaging of depicted mobile telephone 8. A digital signal processor (DSP) 10 receives the outputs of ADCs 103 and 104. DSP 10 includes a processor core 12, a data memory (DMEM) 14 and an instruction memory (IMEM) 16, in which program instructions are stored. Program instructions in IMEM 16 operate on the values received from ADCs 103 and 104 to generate signals for transmission by a global system for mobile communications (GSM) radio 18, among other operations performed within mobile telephone 8. In accordance with an embodiment of the invention, the program instructions within IMEM 16 include program instructions that implement an ambient noise suppressor (ANS) 105, details of which will be described below. IMEM 16 also includes program instructions that implement an adaptive multi-rate codec 106 that encodes the output of ANS 105 for transmission by GSM radio 18, and will generally include other program instructions for performing other functions within mobile telephone 8 and operating on the output of ANS 105, including acoustic echo cancellers (AEC) and automatic gain control circuits (AGCs). The present invention concerns structures and methodologies applied in ANS 105, and therefore details of other portions of mobile telephone 8 are omitted for clarity.

Figure 2:
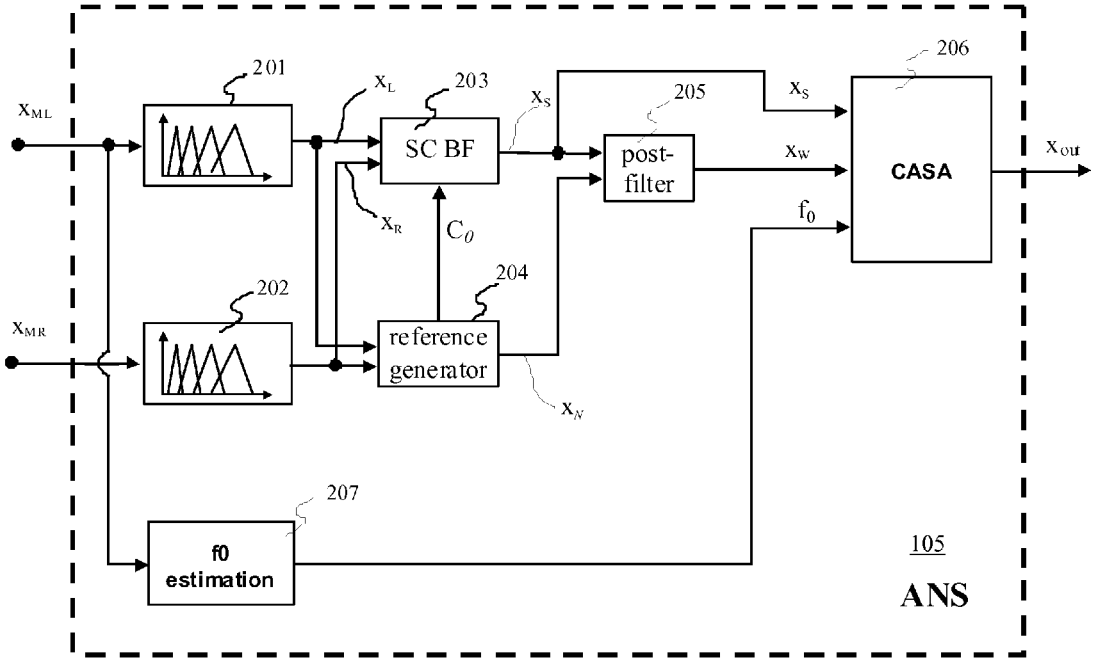
FIG. 2 is a block diagram showing details of ambient noise suppressor (ANS) 105 of FIG. 1.

Referring now to FIG. 2, details of ANS 105 are shown in a block diagram. While ANS 105 in the illustrative embodiment is a set of program instructions, i.e, a set of software modules that implement a digital signal processing method, the information flow within the software modules can be represented as a block diagram, and further a system in accordance with an alternative embodiment of the present invention comprises logic circuits configured as shown in the following block diagrams. Some or all of the signal processing in an embodiment of the present invention may be performed in dedicated logic circuits, with the remainder implemented by a DSP core executing program instructions. Therefore, the block diagrams depicted in FIGS. 2-8 are understood to apply to both software and hardware implementations of the algorithms forming ANS 105 in mobile telephone 8.

Signals $X_{ML}$ and $X_{MR}$, which are digitized versions of the outputs of microphones 101 and 102, respectively, are received by ANS 105 from ADCs 103 and 104. A pair of gammatone filter banks 201 and 202 respectively filter signals $X_{ML}$ and $X_{MR}$, splitting signals $X_{ML}$ and $X_{MR}$ into two sets of multi-band signals $X_L$ and $X_R$. Gammatone filter banks 201 and 202 are identical and have n channels each. In the exemplary embodiment depicted herein, there are sixty-four channels provided from each of gammatone filter banks 201 and 202, with the frequency bands spaced according to the Bark scale. The filters employed are fourth-order infinite impulse response (IIR) bandpass filters, but other filter types including finite impulse response (FIR) filters may alternatively be employed. Multi-band signals $X_L$ and $X_R$ are provided as inputs to a reference generator 204.

Reference generator 204 generates an estimate of the ambient noise $X_N$, which includes all sounds occurring in the acoustic ambient environment of microphones 101 and 102, except for the desired speech signal. Reference generator 204, as will be shown in greater detail below, generates an adaptive control signal $C_\theta$ as part of the process of cancelling the desired speech from the estimate of the ambient acoustic noise $X_N$, which is then used as a steering control signal provided to a steering controlled beam-former (SCBF) 203. SCBF 203 processes multi-band signals $X_L$ and $X_R$ according to the direction of the speaker's head as specified by adaptive control signal $C_\theta$, which in the depicted embodiments is a vector representing parameters of an adaptive filter internal to SCBF 203. The output of SCBF 203 is a multichannel speech signal $X_S$ with partly suppressed ambient acoustic noise due to the directional filtering provided by SCBF 203.

Multichannel speech signal $X_S$ and the estimated ambient acoustic noise $X_N$ are provided to post-filter 205 that implements a time-varying filter similar to a Wiener filter that suppresses the residual noise from multi-channel speech signal $X_S$ to generate another multi-channel signal $X_W$. Multichannel signal $X_W$ is mostly the desired speech, since the estimated noise is removed according to post-filter 205. However, residual interference is further removed by a computational auditory scene analysis (CASA) module 206, which receives the multi-channel speech signal $X_S$, the reduced-noise speech signal $X_W$, and an estimated fundamental frequency $f_0$ of the speech as provided from a fundamental frequency estimation block 207. The output of CASA module 206 is a fully processed speech signal $X_{OUT}$ with ambient acoustic noise removed by directional filtering, filtering according to quasi-stationary estimates of the speech and the ambient acoustic noise, and final post-processing according to CASA. In particular, the post-filtering applied by post-filter 205 provides a high degree of noise filtering not present in other beam-forming systems. Pre-filtering using the directionally filtered speech and the estimated noise according to quasi-stationary filtering techniques provides additional signal-to-noise ratio improvement over scene analysis techniques that are operating on direct microphone inputs or inputs filtered by a multi-source beam-forming technique.

Figure 3:
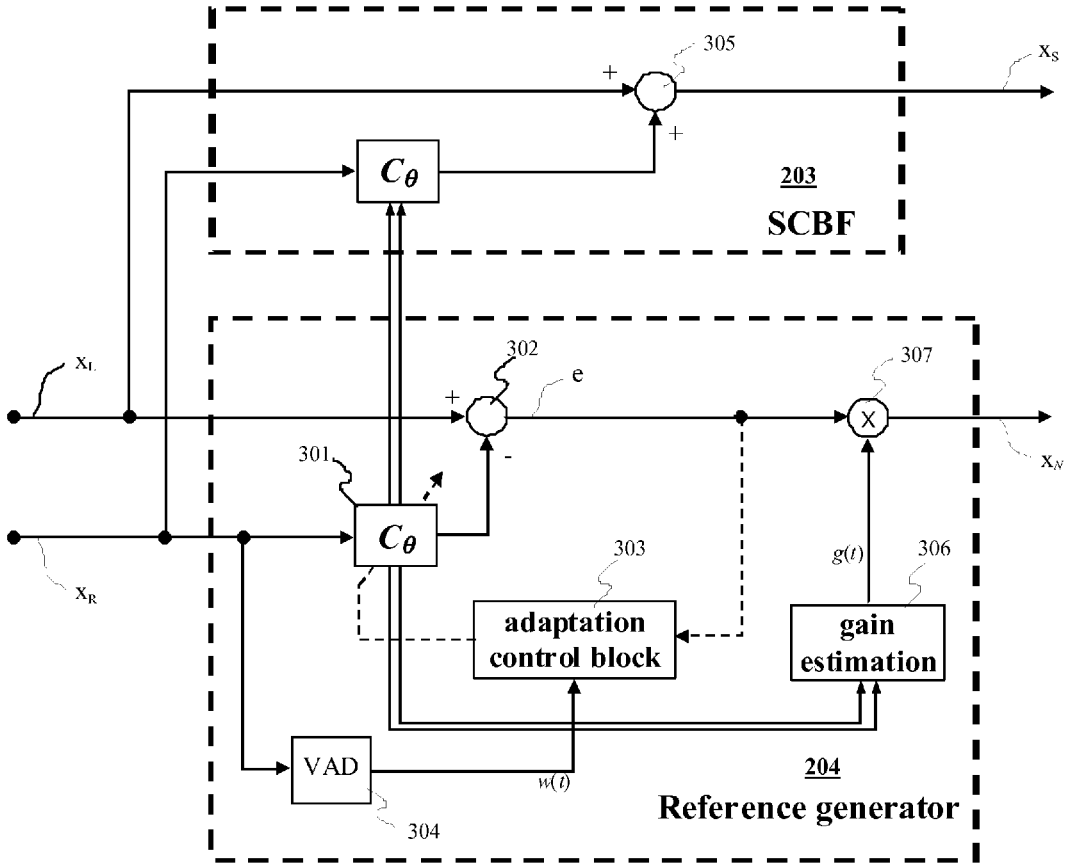
FIG. 3 is a block diagram showing details of steering controller beam-former (SCBF) 203 and reference generator 204 of FIG. 2.

Referring now to FIG. 3, details of reference generator 204 and SCBF 203 are shown. A filter 301 having parameters $C_\theta$ and a subtractor 302 form a normalized least-means-squared (NLMS) adaptive filter that is controlled by a voice activity detector 304. The adaptive filter suppresses speech in multichannel signal $X_L$ by using multichannel signal $X_R$ as reference. Subtractor 302 subtracts the output of filter 301, which filters multichannel signal $X_R$, from multichannel signal $X_L$. An adaption control block 303 tunes filter 301 by adjusting parameters $C_\theta$, so that at the output of subtractor 302 the desired speech signal is canceled, effectively steering a directivity null formed by subtractor 302 that tracks the speaker's head. There is high correlation between the ambient acoustic noise components of multichannel signals $X_L$ and $X_R$ signals, particularly in the low frequency channels, where wavelengths are long compared to the distance between microphones 101 and 102.

Adaption control block 303 can adapt parameters $C_\Theta$ according to minimum energy in error signal e, which may be qualified by observing only the lower frequency bands. Error signal e is by definition given by $E(t)=X_L(t)-C_\Theta X_R(t)$, where t is an instantaneous time value, and a NLMS algorithm can be used to estimate $C_\Theta$ according to:

$$\hat{C}_\theta(t) = \hat{C}_\theta(t-1) + \mu \frac{E(t)}{|X_R(t)|^2 + \delta^2} X_R^*(t)$$

where μ is a positive scalar that control the convergence rate of time-varying parameters $C_\Theta$ (t), δ is a positive scalar that provides stability for low magnitudes of multichannel signal $X_R$. Adaptation can be stopped during non-speech intervals, according to the output of VAD 304, which decides whether speech is present from the instantaneous power of multichannel signal $X_R$, trend of the signal power, and dynamically estimated thresholds.

As noted above, in addition to providing input to adaptation block 303, error signal e is also used for estimation of the ambient acoustic noise. While the speech signal is highly suppressed in error signal e, the ambient noise is also, since microphones 101 and 102 are closely spaced and the ambient acoustic noise in multichannel signals $X_L$ and $X_R$ is therefore highly correlated. A gain control block 306 calculates a gain factor that compensates for the noise attenuation caused by the adaptive filter formed by subtractor 302 and filter 301. The output of multiplier 307, which multiplies error signal e by a gain factor g(t), is estimated ambient acoustic noise signal $X_N$.

Figure 4:
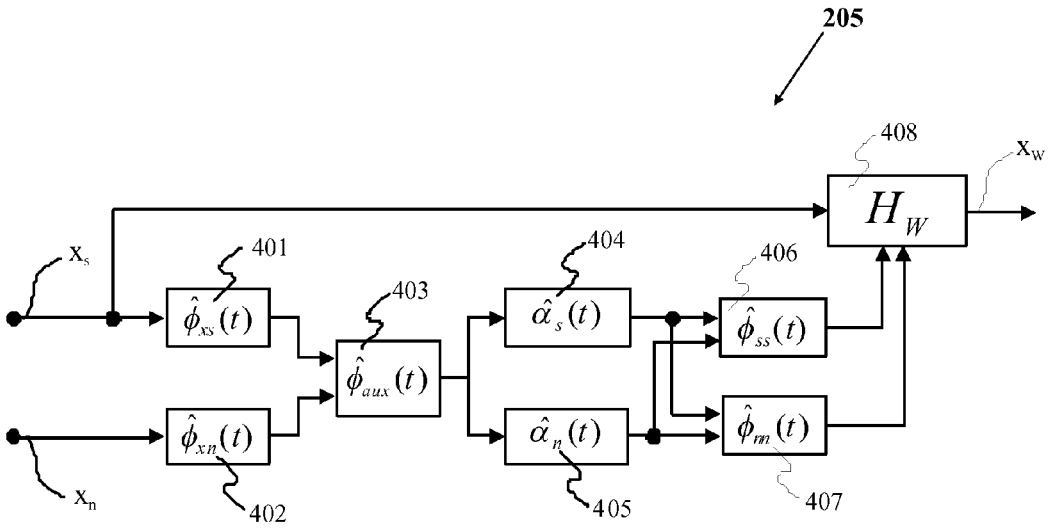
FIG. 4 is a block diagram showing details of post-filter 205 of FIG. 2.

Referring now to FIG. 4, details of post-filter 205 of FIG. 2 are shown. The inputs to postfilter 205 are multichannel speech signal $X_S$ and estimated acoustic ambient noise $X_N$. Post-filter 205 has a noise reducing filter block 408 that estimates a Wiener filter transfer function defined by:

$$H_W = \frac{\phi_{ss}}{\phi_{ss} + \phi_{nn}}$$

where $\phi_{ss}=E(ss^*)$ is short time speech power given s as the speech signal, and $\phi_{nn}=E(nn^*)$ is short time noise power, given n as the instantaneous noise. Filter block 408 receives multichannel speech signal $X_S$ and generates reduced-noise multi-channel speech signal $X_W$. Both $\phi_{ss}$ and $\phi_{nn}$, which are provided from computation blocks 406 and 407, respectively, are estimated from both of multichannel speech signal $X_S$ and estimated acoustic ambient noise $X_N$. The short-term power $\Phi_{xs}$ of multichannel speech signal $X_S$ can be modeled by:

$$\phi_{xs}=E(X_S X^*_S)=\phi_{ss}+\phi_{nn}$$

where $\phi_{ss}=E(ss^*)$ is short-term power of the speech component in multichannel speech signal $X_S$, and $\phi_{nn}=E(nn)$ is the short-term power of the noise component in multichannel speech signal $X_S$. The short-term power of estimated acoustic ambient noise $X_N$ can be modeled by:

$$\phi_{xn}=E(X_N X_N^*)=\alpha_s\phi_{ss}+\alpha_n\phi_{nn}, \alpha_s<<\alpha_n$$

Speech is highly attenuated in signal $X_N$, $\alpha_s<<1$ while the noise power attenuation is partly compensated by gain factor g(t). Therefore, $\alpha_n\approx 1$. With the assumption that $\phi_{xs}$, $\phi_{xn}$, $\alpha_s$ and $\alpha_n$ are known, then the short-term power of the speech and noise can be reduced to:

$$\phi_{ss} = \frac{\phi_{xn} - \alpha_n\phi_{xs}}{\alpha_s - \alpha_n}, \ \phi_{nn} = \frac{\alpha_s\phi_{xs} - \phi_{xn}}{\alpha_s - \alpha_n},$$

which are computed by computation blocks 406 and 407, respectively. Since values $\phi_{xn}$ and $\phi_{xs}$ are time-varying, they can be estimated by first order IIR filters 401 and 402, respectively, according to:

$$\hat{\phi}_{sx}(t)=\lambda\hat{\phi}_{xs}(t-1)+(1-\lambda)x_S^*(t)x_S(t)$$

$$\hat{\phi}_{xn}(t)=\lambda\hat{\phi}_{xn}(t-1)+(1-\lambda)x_N^*(t)x_N(t),$$

where λ=0.99 is an exponential forgetting factor. As $\alpha_s$ and $\alpha_n$ are unknown, they are estimated using auxiliary variable $\phi_{aux}$ (t) calculated in divider 403 as:

$$\phi_{aux}(t) = \frac{\hat{\phi}_{xn}(t)}{\hat{\phi}_{xs}(t)}$$

First $\phi_{aux}$(t) is processed by a first order IIR filter 404 according to:

$$\hat{\phi}_{aux}(t)=\lambda_1\hat{\phi}_{aux}(t-1)+(1-\lambda_1)\phi_{aux}(t), 0<\lambda_1<1,$$

where $\lambda_1$ is a constant. Then $\alpha_s$, which is the expected value of $\phi_{aux}$(t) over the non-speech interval, is estimated by recursive minimum estimation using another IIR filter with two different forgetting factors according to:

$$\hat{\alpha}_s(t) = \begin{cases} 0.9\hat{\alpha}_s(t-1) + 0.1\hat{\phi}_{aux}(t), & \text{for } \hat{\alpha}_s(t-1) < \hat{\phi}_{aux}(t) \\ 0.999\hat{\alpha}_s(t-1) + 0.001\hat{\phi}_{aux}(t), & \text{for } \hat{\alpha}_s(t-1) \geq \hat{\phi}_{aux}(t) \end{cases}$$

Similarly, $\alpha_n$ is estimated by recursive maximum estimation using an IIR filter 405 with two different forgetting factors according to:

$$\hat{\alpha}_n(t) = \begin{cases} 0.999\hat{\alpha}_n(t-1) + 0.001\hat{\phi}_{aux}(t), & \text{for } \hat{\alpha}_n(t-1) < \hat{\phi}_{aux}(t) \\ 0.9\hat{\alpha}_n(t-1) + 0.1\hat{\phi}_{aux}(t), & \text{for } \hat{\alpha}_n(t-1) \geq \hat{\phi}_{aux}(t) \end{cases}$$

At output of the filters 404 and 405 there are estimates of $\alpha_s$ and $\alpha_n$, respectively. By providing $\alpha_s$ and $\alpha_n$ as inputs to each of computation blocks 406 and 407, estimates of speech and noise powers $\phi_{ss}$ and $\phi_{nn}$ are obtained at their respective outputs. Noise powers $\phi_{ss}$ and $\phi_{nn}$ are then used to estimate the Wiener filter, as noted above.

Figure 5:
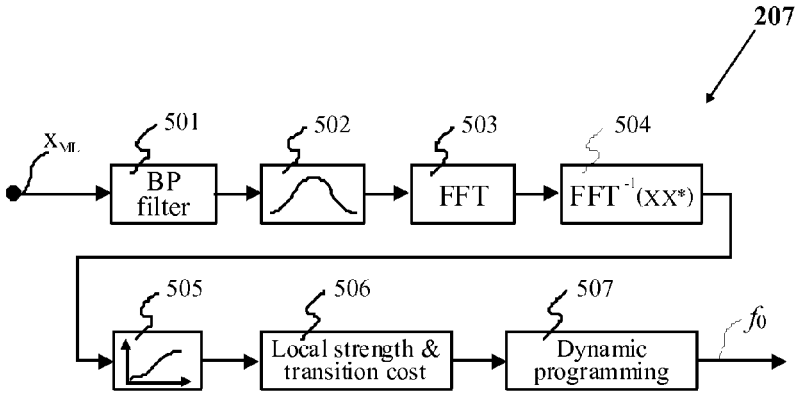
FIG. 5 is a block diagram showing details of fundamental frequency estimation block 207 of FIG. 2.

Referring now to FIG. 5, details of $f_0$ estimation block 207 of FIG. 2 are shown. A bandpass filter 501 limits the frequency range of microphone signal $X_{ML}$ to a frequency range of approximately 70 Hz to 1000 Hz. The output of bandpass filter is partitioned into overlapping segments 43 ms wide and a window function is applied by block 502. A fast-fourier transform 503 is performed on the output of window function and an autocorrelation module 504 computes the autocorrelation of the windowed and bandlimited microphone signal $X_{ML}$. A compensation filter 505 compensates for the influence of the window function, e.g., longer autocorrelation lag in windowed and bandlimited microphone signal $X_{ML}$, and then multiple candidates for fundamental frequency $f_0$ are tested by selection of local minima, computation of local strength and computation of a transition cost associated with every candidate. Finally for a dynamic programming algorithm module 507 selects the best candidate and estimates fundamental frequency $f_0$.

Figure 6:
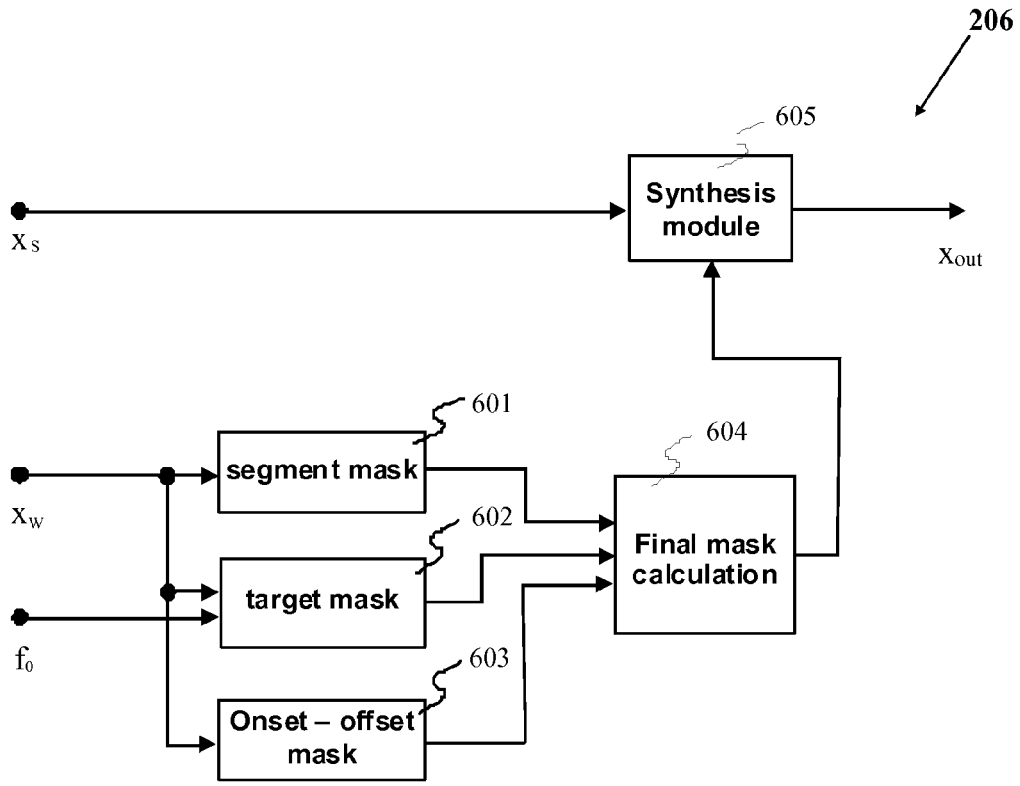
FIG. 6 is a block diagram showing details of CASA module 206 of FIG. 2.

Referring now to FIG. 6, details of CASA module 206 of FIG. 2 are shown. CASA module 206 has two stages and determines three masks at the first stage. A segment mask is computed from reduced-noise multichannel speech signal $X_W$ by a segment mask computation block 601. A target mask is computed by estimated fundamental frequency $f_0$ and reduced-noise multichannel speech signal $X_W$ and an onset-offset mask is also computed from reduced-noise multi-channel speech signal $X_W$. The three first-stage masks are combined into a unique final mask in final mask calculation module 604. The final mask is used for speech enhancement and suppression of interference in a speech synthesis module 605 that generates fully processed speech signal $X_{OUT}$. Synthesis of speech from masked channel signals is performed using a time alignment method, without requiring computation intensive FIR filtering. The total analysis/synthesis delay time in the depicted embodiment is 4 ms, which in mobile phone applications is a desirably short delay.

The output of target mask computation block 602 is 64-channel vector of binary decisions of whether the time-frequency elements of reduced-noise multi-channel speech signal $X_W$ contain a component of estimated fundamental frequency $f_0$. An autocorrelation is calculated for each channel using a delay that corresponds to the estimated $f_0$. The autocorrelation value is normalized by signal power and compared to a threshold. If the resultant value exceeds a predefined threshold, the decision is one (true), otherwise the decision is zero (false). For the channels of reduced-noise multi-channel speech signal $X_W$ having a center frequency greater than 800 Hz, the autocorrelation function is calculated on a complex envelope, which reduces the influence of the residual noise on the mask estimation.

Segment mask computation block 601 computes a measure of similarity of spectra in neighboring channels of reduced-noise multi-channel speech signal $X_W$. Since the formant structure of speech spectra concentrates signal around formants, non-formant interferences can be identified on the basis of rapid changes in power of adjacent channels. Typical segment mask computation techniques use autocorrelation, which is computation intensive. While such techniques may be used in certain embodiments of the present invention, according to the exemplary embodiment described herein, a spectral distance measure that does not use autocorrelations is employed. A correlation index is calculated using time-domain waveform data on the channels of reduced-noise multi-channel speech signal $X_W$ that have a center frequency below 800 Hz. For channels having a central frequency over 800 Hz, an amplitude envelope of the complex signal is used to compute the correlation index calculation according to the following:

$$D_c(t, f_i, f_{i+1}) = \frac{\sum_{n=0}^{N-1} \tilde{x}_W(t-n, f_i)\tilde{x}_W(t-n, f_{i+1})}{\sqrt{\sum_{n=0}^{N-1} \tilde{x}_W(t-n, f_i)\tilde{x}_W(t-n, f_i) \sum_{n=0}^{N-1} \tilde{x}_W(t-n, f_{i+1})\tilde{x}_W(t-n, f_{i+1})}},$$

where $D_C$ is the spectral distance measure, N is the number of samples, and $f_i$, $f_{i+1}$ the center frequencies of two adjacent channels. The segment mask is a real-valued number between zero and one. Unlike autocorrelation-based spectral measures that are insensitive to phase difference between neighboring channels, the spectral measure of the exemplary embodiment is sensitive to the phase differences of neighboring channels.

Onset-offset mask computation block 603 separates speech segments from background noise using a time-frequency model that has a rapid increase in signal energy indicating the beginning of a speech interval that then ends with fall of the signal energy below the noise floor. The ambient acoustic noise may be stationary as a fan-noise which has no onset and offset, which can be easily separated from speech using the above-described time-frequency model. Also, ambient acoustic noise may be non-stationary, for example the sound of a ball bouncing against a gym floor. In the non-stationary case, a rule for the segment length is used to separate speech from noise.

While reduced-noise multi-channel speech signal $X_W$ is used for mask calculation in CASA module 206, multi-channel signal Xs is used for speech synthesis. Using multi-channel signal Xs as the basis for output speech synthesis instead of reduced-noise multi-channel speech signal $X_W$ prevents double filtering and possibility of the speech distortion due to the double filtering as CASA module 206 interacts with the filtering action in post-filter 205.

Figure 7:
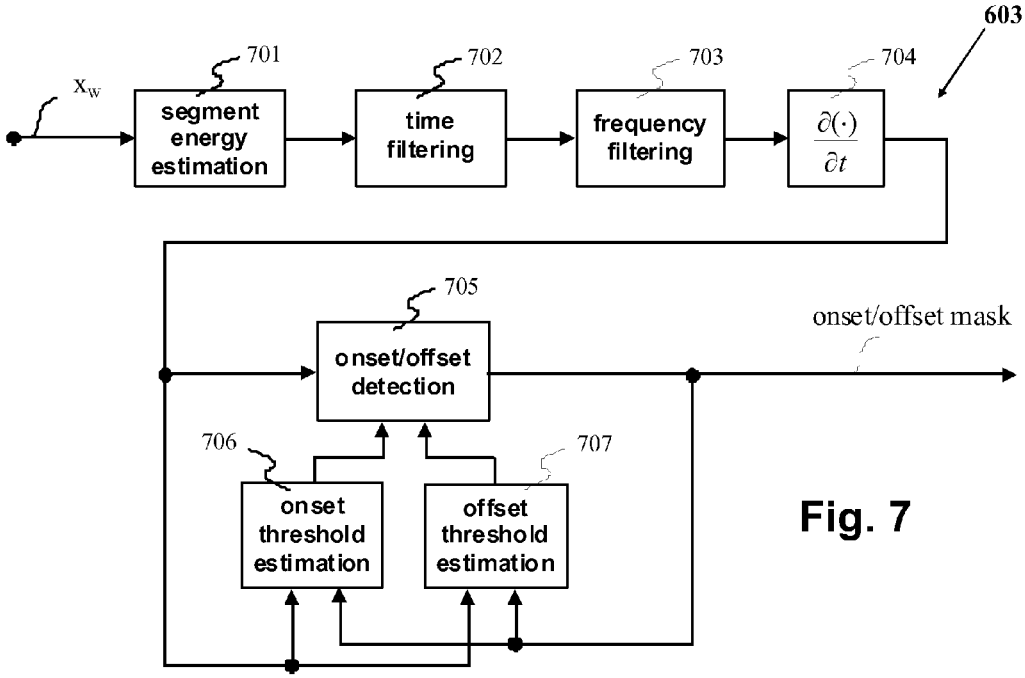
FIG. 7 is a block diagram showing details of offset-onset mask estimation block 603 of FIG. 6.

Referring now to FIG. 7, details of onset-offset mask computation block 603 of FIG. 6 are depicted. Onset-offset mask computation block 603 identifies speech segments that begin with an onset and end with an offset. A segment energy estimation block estimates the energy in the channels of reduced-noise multi-channel speech signal $X_W$, and in the exemplary embodiment, are calculated on segments 64 samples long. Next, the energy estimates are low-pass filtered in time by a time filtering block 702 and across the channels by a frequency filtering block 703. Time derivatives of low-pass filtered (smoothed) energy values are used to enhance rapid changes in signal power and are computed by a differentiation block 704. Onset/offset detection is performed on the output of differentiation block 704 in an onset-offset detection module 705. If the time derivative of the smoothed energy values exceed the onset threshold, onset is detected. Onset-offset detection module 705 then searches for the offset. When the time derivative of the smoothed energy falls below the offset threshold, offset is detected. Certain rules have been imposed in the exemplary embodiment that have produced enhanced results:

1. Speech segments are not permitted to be less than 40 ms. Segments less then 40 ms are enlarged to 40 ms.
2. The offset threshold is provided as a time-varying value by offset threshold estimation module 707. Immediately after an onset, offset threshold is set to a high value to prevent early offset detection. The offset threshold decreases with time to increase the probability of the offset detection. Decrease of the offset threshold prevents long speech segments. Speech segments of the channel signals are alternated with pauses after a change of phoneme. Very long speech segments in channel signals rarely occur in normal speech.

3. Onset threshold is estimated by onset threshold estimation module 706 using ambient noise power determined after offset detection. Accurate noise power estimate provides better estimate of the ideal onset threshold that increases the probability of the onset detection.

Figure 8:
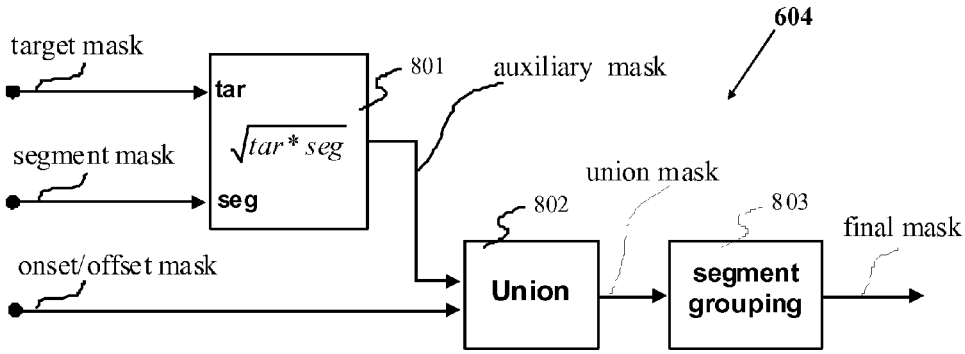
FIG. 8 is a block diagram showing details of final mask calculation module 604 of FIG. 6.

Referring now to FIG. 8, details of final mask calculation block 604 of FIG. 6 are depicted. Final mask calculation block 604 calculates a final mask on basis of the target, segment and onset/offset masks described above. The target and segment masks are used to form an auxiliary mask at output of auxiliary mask computation module 801. A union mask is formed at output of a union mask computation module 802 from the onset/offset and the auxiliary mask. The union mask is real valued. The union mask requires some post-processing due to non-zero element groups that have too few time-frequency (TF) units due to mis-estimation of the frequency width and duration of the speech segment. Therefore, segment grouping module 803 searches for groups having less than eight TF units and sets them to zero to further suppress noise. The output of segment grouping module 803 is a final mask that is used for speech synthesis by speech synthesis module 605 of FIG. 6.

While the invention has been particularly shown and described with reference to the preferred embodiments thereof, it will be understood by those skilled in the art that the foregoing and other changes in form and details may be made therein without departing from the spirit and scope of the invention.

What is claimed:

1. A method of separating speech from ambient acoustic noise to generate a speech output signal from a speech source, comprising:

generating multiple microphone output signals from corresponding multiple microphones located at multiple physical positions;

filtering the multiple microphone output signals to split each of the multiple microphone signals into a plurality of frequency band-limited output signals for each of the multiple microphone signals;

forming a spatial beam having a primary lobe having a direction adjusted by a beam-former, wherein the beam-former has multiple inputs for receiving the plurality of band-limited output signals for each of the multiple microphone signals;

adaptively filtering at least one of the plurality of frequency band-limited output signals to periodically determine a position of the speech source and generate a steering control value;

adjusting the direction of the primary lobe of the beam-former toward the determined position of the speech source according to the steering control value;

generating an estimate of the ambient acoustic noise by removing speech from the plurality of band-limited output signals;

post-filtering an output of the beam-former in conformity with the estimate of the ambient acoustic noise, wherein the post-filtering applies a transfer function to the output of the beam-former that is frequency-dependent on content of the estimate of the ambient acoustic noise; and processing the output of the beam-former in conformity with a result of the post-filtering to suppress residual noise in the output of the beam-former and generate the speech output signal therefrom.

2. The method of claim 1, wherein the post-filtering is performed by a time varying filter controlled by comparison of the two or more outputs of the beam-former with a quasi-stationary model of the speech and the ambient acoustic noise.

3. The method of claim 1, wherein the filtering the multiple microphone output signals is performed by a multi-band gammatone filter for each of the multiple microphone signals.

4. The method of claim 3, wherein the adaptively filtering the plurality of frequency band-limited output signals adaptively filters two or more outputs of the multi-band gammatone filter to generate the steering control value.

5. The method of claim 1, wherein the processing the output of the beam-former to reduce residual noise comprises performing computation auditory scene analysis (CASA) on the output of the beam-former in conformity with the result of the post-filtering.

6. The method of claim 5, wherein the forming a spatial beam is performed by a multi-band beam-former having outputs corresponding to the plurality of frequency bands, and wherein the outputs of the multi-band beam-former provide inputs to the CASA corresponding to multiple processing frequency bands used by the CASA.

7. The method of claim 6, further comprising:

estimating the speech signal; and post-filtering the output of the beam-former in conformity with a result of the estimating the ambient acoustic noise and a result of the estimating the speech signal.

8. The method of claim 7, wherein a result of the post-filtering provides an input to the CASA for determining one or more masks used in CASA processing.

9. A signal processing system for electrically separating speech from a speech source from ambient acoustic noise to generate a speech output signal, comprising:

multiple microphone inputs for receiving multiple microphone output signals from microphones at multiple physical positions;

multiple multi-band filters for filtering the multiple microphone output signals to split each of the multiple microphone signals into a plurality of frequency band-limited output signals for each of the multiple microphone signals;

a beam-former for forming a spatial beam having a primary lobe having a direction adjusted by a steering control value, wherein the beam-former has multiple inputs for receiving the plurality of band-limited output signals for each of the multiple microphone signals;

an adaptive filter for periodically determining a position of the speech source and generating the steering control value;

an estimator for generating an estimate of the ambient acoustic noise by removing speech from the plurality of band-limited output signals;

a post filter for post-filtering an output of the beam-former in conformity with the estimate of the ambient acoustic noise, wherein the post-filter has a transfer function that is frequency-dependent on content of the estimate of the ambient acoustic noise; and a processing block that receives the output of the beam-former and the output of the post filter and that processes the output of the beam-former in conformity with the output of the post filter to suppress residual noise in the output of the beam-former and to generate the speech signal therefrom.

10. The signal processing system of claim 9, further comprising:

a processor for executing program instructions;

a memory for storing the program instructions coupled to the processor; and one or more analog-to-digital converters having inputs coupled to the multiple microphone inputs, and wherein the multi-band filters, the beam-former, the adaptive filter, the estimator and the processing block are implemented by modules within the program instructions as executed by the processor.

11. The signal processing system of claim 10, wherein the post-filter is a time varying filter that compares two or more outputs of the beam-former with a quasi-stationary model of the speech and the ambient acoustic noise.

12. The signal processing system of claim 9, wherein the multi-band filters are multi-band gammatone filters, one for each of the multiple microphone signals.

13. The signal processing system of claim 12, wherein the adaptive filter filters two or more outputs of the multi-band gammatone filter to generate the steering control value.

14. The signal processing system of claim 9, wherein the processing block is a computation auditory scene analysis (CASA) processing block that receives an input from the beam-former and another input from the post filter.

15. The signal processing system of claim 14, wherein the beam-former is a multi-band beam-former having outputs corresponding to the plurality of frequency bands, and wherein the outputs of the multi-band beam-former provide inputs to the CASA processing block corresponding to multiple processing frequency bands used by the CASA processing block.

16. The signal processing system of claim 15, wherein the estimator is a first estimator, and further comprising:

a second estimator for estimating the speech signal; and a post-filter for filtering the output of the beam-former in conformity with an output of the first estimator and an output of the second estimator.

17. The signal processing system of claim 16, wherein an output of the post-filter provides an input to the CASA for determining one or more masks used in CASA processing.

18. A computer-program product comprising a non-transitory computer-readable storage device storing program instructions for execution by a digital signal processor for separating speech of a speech source from ambient acoustic noise to generate a speech output signal, the program instructions comprising program instructions for:

receiving values corresponding to multiple microphone output signals from corresponding multiple microphones located at multiple physical positions;

filtering the multiple microphone output signals to split each of the multiple microphone signals into a plurality of frequency band-limited output signals for each of the multiple microphone signals;

forming a spatial beam having a primary lobe having a direction adjusted by a beam-former, wherein the beam-former has multiple inputs for receiving the plurality of band-limited output signals for each of the multiple microphone signals;

adaptively filtering at least one of the plurality of frequency band-limited output signals to periodically determine a position of the speech source and generate a steering control value;

adjusting the direction of the primary lobe of the beam-former toward the determined position of the speech source according to the steering control value;

generating an estimate of the ambient acoustic noise by removing speech from the plurality of band-limited output signals;

post-filtering an output of the beam-former in conformity with the estimate of the ambient acoustic noise, wherein the post-filtering applies a transfer function to the output of the beam-former that is frequency-dependent on content of the estimate of the ambient acoustic noise; and processing the output of the beam-former in conformity with a result of the post-filtering to suppress residual noise in the output of the beam-former and generate the speech output signal therefrom.

19. The computer program product of claim 18, wherein the program instructions for post-filtering implement a time varying filter controlled by comparison of the two or more outputs of the beam-former with a quasi-stationary model of the speech and the ambient acoustic noise.

20. The computer program product of claim 18, wherein the program instructions for filtering the multiple microphone output signals implement a multi-band gammatone filter for each of the multiple microphone signals.

21. The computer program product of claim 20, wherein the program instructions for adaptively filtering the plurality of frequency band-limited output signals adaptively filter two or more outputs of the multi-band gammatone filter to generate the steering control value.

22. The computer program product of claim 18, wherein the program instructions for processing the output of the beam-former to reduce residual noise comprise program instructions for performing computation auditory scene analysis (CASA) on the output of the beam-former in conformity with the result of the post-filtering.

23. The computer program product of claim 22, wherein the program instructions for forming a spatial beam implement a multi-band beam-former having outputs corresponding to the plurality of frequency bands, and wherein the outputs of the multi-band beam-former provide inputs to the CASA corresponding to multiple processing frequency bands used by the CASA.

24. The computer program product of claim 22, further comprising program instructions for:

estimating the speech signal; and post-filtering the output of the beam-former in conformity with a result of the estimating the ambient acoustic noise and a result of the estimating the speech signal.

25. The computer program product of claim 24, wherein a result of the post-filtering provides an input to the CASA for determining one or more masks used in CASA processing.

* * * * *